US006319058B1

(12) United States Patent
Jones

(10) Patent No.: US 6,319,058 B1
(45) Date of Patent: Nov. 20, 2001

(54) PAIR OF CONNECTORS CLAMPING A PRINTED CIRCUIT BOARD

(75) Inventor: Dennis B. Jones, Orange, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/597,859

(22) Filed: Jun. 20, 2000

(51) Int. Cl.[7] ..... H01R 13/73
(52) U.S. Cl. ..... 439/567
(58) Field of Search ..... 439/567, 571, 439/908, 572

(56) References Cited

U.S. PATENT DOCUMENTS 4,363,530 * 12/1982 Verhoeven ..... 439/571
5,080,611 * 1/1992 Niitsu et al. ..... 439/567
5,254,016 * 10/1993 Ganthier ..... 439/567
5,482,474 * 1/1996 Yohn et al. ..... 439/567
5,634,810 * 6/1997 Niitsu et al. ..... 439/567
5,921,812 * 7/1999 Choy ..... 439/567

* cited by examiner

*Primary Examiner*—Gary Paumen
(74) *Attorney, Agent, or Firm*—Wei Te Chung

(57) ABSTRACT

A pair of first connector and second connector clamps a printed circuit board therebetween. The first connector comprises a first body portion having a reception space defined from a bottom to a top thereof. The printed circuit board defines a hole registering with the reception space. The second connector comprises a second body portion defining a recess for receiving a board lock which has a fixed section engaged within the recess and a pair of spring prongs connected to the fixed section and retained in the reception space of the first connector, therefore the first connector and the second clamp the printed circuit board.

1 Claim, 4 Drawing Sheets

PAIR OF CONNECTORS CLAMPING A PRINTED CIRCUIT BOARD

BACKGROUND OF THE INVENTION

1. Field of the Invention

The present invention relates to a pair of connectors clamping a printed circuit board, particularly to a pair of connectors located back to back at opposite sides of the printed circuit board.

2. The Prior Art

Electrical connectors are used popularly for interconnection between two electrical devices which may be mother boards, hard disk drivers or the like. The interconnection configurations of the connectors and the electrical devices may be different according to respective structural requirements of electrical systems. One of the configurations is to provide a single connector having opposite mating surfaces for connection with electrical devices on opposite sides of a printed circuit board which has a hole for location of the opposite-mating-surface connector. However, the manufacturing of this kind of connector is difficult and high cost. Therefore, some manufacturers just make this connector separated into two connectors. For compensating the soldering strength of the pins in opposite sides of the printed circuit board, each connector is installed with a pair of board locks in distal ends thereof preventing the soldering circuit from being damaged during frequent insertion/withdrawal of the external electrical devices. However, this will make complicated on the printed circuit board because there are altogether four holes are needed for securing the board locks. U.S. Pat. Nos. 5,080,611, 5,254,016 and 5,921,812 disclose arrangements of two connectors mounted on two opposite sides of a single circuit board. Nevertheless, it is requisite to provide a new structure on the two connectors which need less board locks yet still maintain the securing function thereof.

SUMMARY OF THE INVENTION

The primary purpose of the present invention is to provide a pair of connectors fixed on opposite sides of a printed circuit board while using a common board lock secured to each other thereby clamping the printed circuit board.

One aspect of the present invention is to provide a pair of first connector and second connector clamping a printed circuit board therebetween. The first connector comprises a first body portion having a reception space defined from a bottom to a top thereof. The printed circuit board defines a hole registering with the reception space. The second connector comprises a second body portion defining a recess for receiving a board lock which has a fixed section engaged within the recess and a pair of spring prongs connected to the fixed section and retained in the reception space of the first connector, therefore the first connector and the second clamp the printed circuit board.

Another aspect of the present invention is to provide a connector assembly having a printed circuit board having a hole defined therein, a first connector having a first recess, and a second connector having a board lock extending therefrom for engagement with the first connector in the first recess thereof. The board lock of the second connector passes through the hole of the printed circuit board and the first connector and the second connector together clamp the printed circuit board.

Further another aspect of the present invention is to provide back-to-back connector assembly comprising a first connector and a second connector back-to-back installed on two opposite sides of a printed circuit board. The first connector comprises a first housing having a first mating face for engagement with an external electrical device and a first body portion in which a reception space is defined. The second connector comprises a second housing having a second mating face for engagement with another external electrical device and a second body portion from which a board lock extends. A printed circuit board has a hole through which the board lock of the second connector extends and engages within the reception space of the first connector. The first mating face of the first connector and the second mating face of the second connector are oriented in opposite directions.

DETAILED DESCRIPTION OF THE PREFERRED EMBODIMENT

Figure 1:
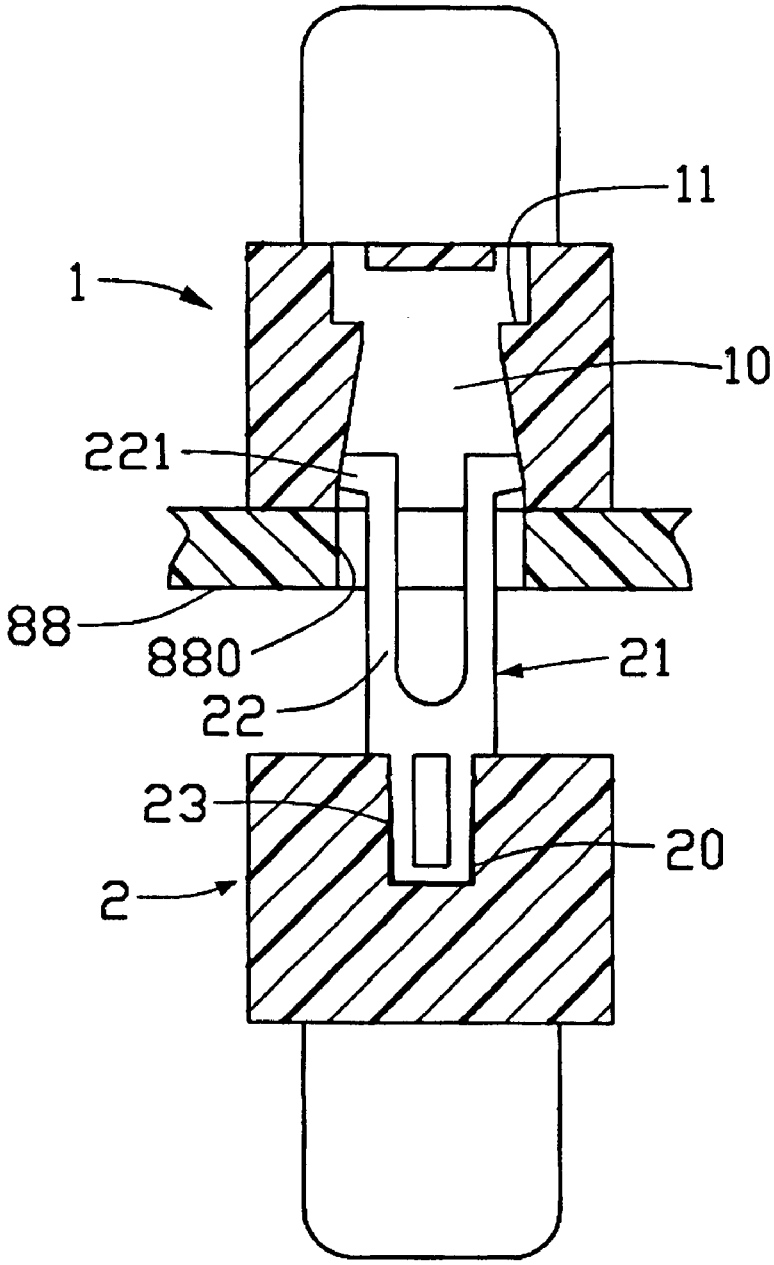
FIG. 1 is a schematic view of a first connector being engaged with a second connector in accordance with the present invention.

Referring to FIG. 1, a first connector 1 and a second connector 2 in accordance with the present invention are during engagement with each other, with a printed circuit board 88 located therebetween. The first connector 1 has a dielectric body portion 15 integrally connected to a dielectric housing portion 16 having a mating face 17 for engagement with an external electrical device (not shown). It should be noted that the present invention does not focus on the housing portion 16 and all electrical contacts (not shown) received therein, therefore the detailed thereof is omitted herein. A reception space 10 is defined in the first body portion 15 and is firstly converged upward then diverged for a subsequent portion thereof, thereby forming oppositely positioning steps 11 in the internal periphery thereof.

The first connector 1 is positioned on a printed circuit board 88 which has a hole 880 manually registered with the reception space 10 of the first connector 1 for configuration purpose. The dimension of the hole 880 is substantially identical to that of the opening of the reception space 10 of the first connector 1.

The second connector 2 has a dielectric body portion 25 integrally connected to a dielectric housing 26 having a mating face 27 for engagement with an external electrical device (not shown). It should be noted that the present invention does not focus on the housing portion 26 and all electrical contacts (not shown) received therein, therefore the detailed thereof is omitted herein. A recess 20 is defined at a bottom of the body portion 25 for receiving a board lock 21. The board lock 21 has a fixed section 23 having barbs at 20 opposite sides thereof, and two spring prongs 22 connected to the fixed section 23. Each spring prong 22 has a bent head 221 for engagement with the positioning step 11 formed inside of the first connector 1.

Figure 2:
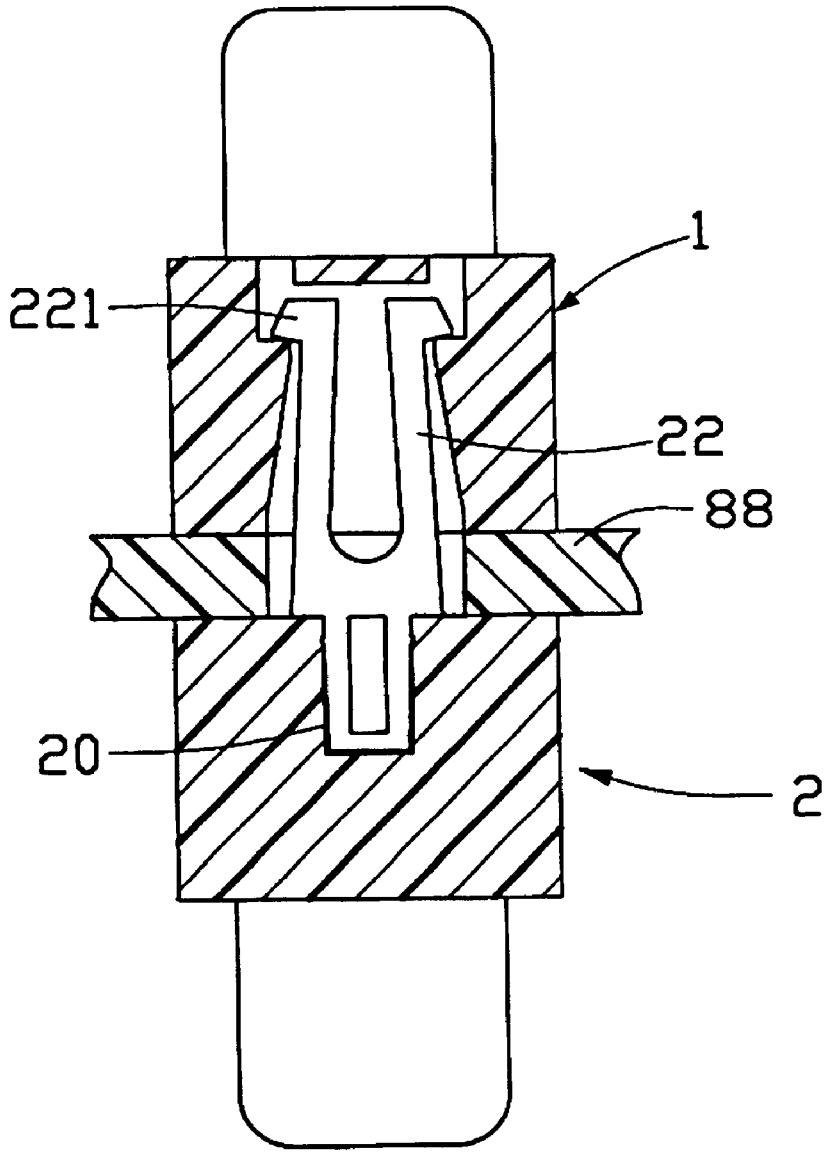
FIG. 2 is a schematic view showing that the first connector and the second connector have been fully connected to each other and a printed circuit board is fixed therebetween
Figure 3:
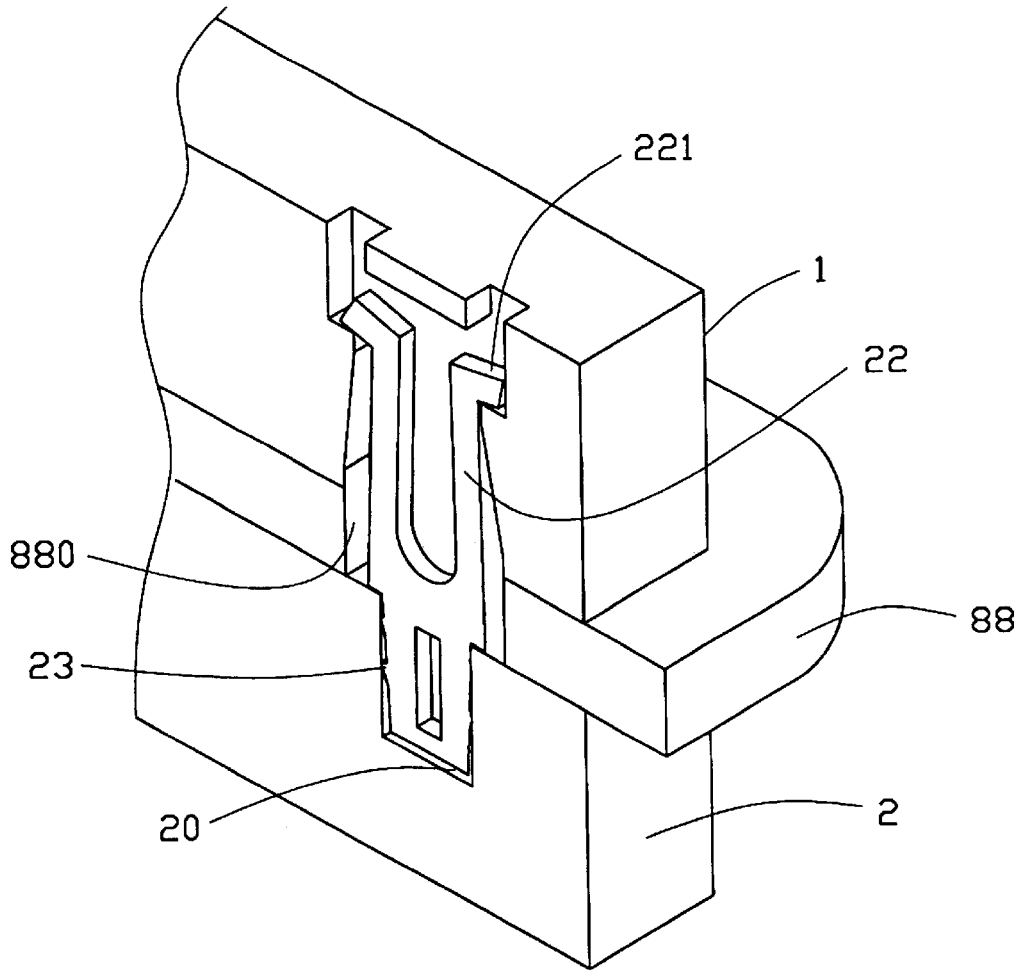
FIG. 3 is a partially cut-off perspective view showing the relation between the first connector, the printed circuit board, and the second connector.

Referring to FIGS. 2 and 3, the second connector 2 is continuously pushed to the first connector 1 until the body

25 thereof contact with the printed circuit board 88 and the bent head 221 of each prong 22 abuts against the positioning step 11 of the first connector 1, meanwhile the first connector 1 and the second connector 2 clamp the printed circuit board 88 and the three components including the first connector 1, the printed circuit board 88, and the second connector 2 are firmly linked together. With this structure, the subsequent soldering procedure on opposite sides of the printed circuit board 88 may be easily achieved without extra jig. A most important advantage of this firmly linked structure is in that the soldering circuit between the connectors 1, 2 and the printed circuit board 88 will not be damaged by frequent insertion/removal of external electrical devices in/from the connectors 1, 2.

Figure 4:
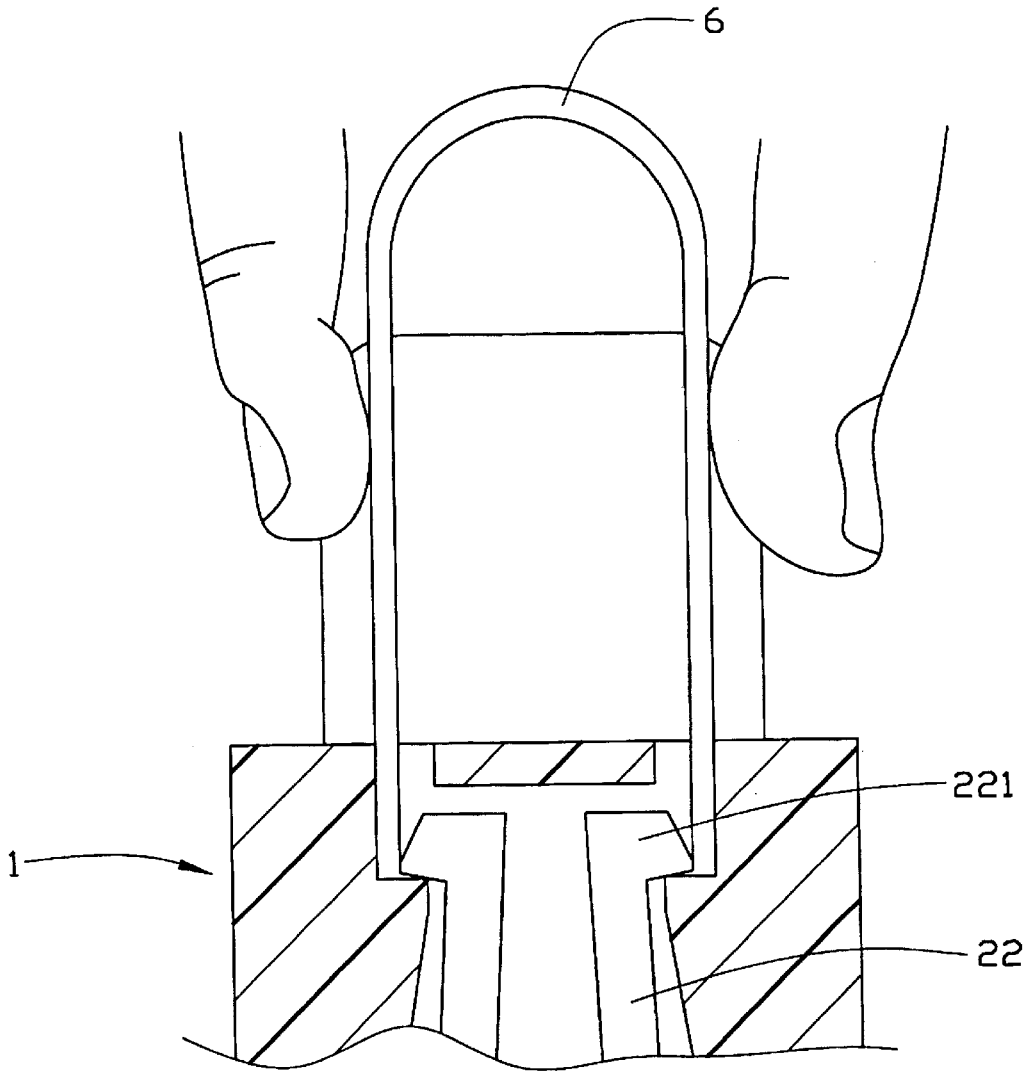
FIG. 4 is a schematic view showing that a U-shaped tool may be used to release the two connectors of FIG. 3.

If the soldering procedure has not been performed and the firmly linked structure needs to be disassembled at this time, a U-shaped tool 6 referred to FIG. 4 may be used. The U-shaped tool 6 may be used to clamp on the bent heads 221 to deform the spring prongs 22, meanwhile the second connector 2 may be pulled away from the first connector 1, thereby disassembling the firmly linked structure. It is noted that different from the conventional board lock having double tapered configurations in both upward and downward directions for easy assembling/disassembling to the printed circuit board, the invention is adapted to be provided with only the downward tapered configuration for insertion while with a locking head 221 for latchable engagement with the corresponding positioning step 11 for firm securement thereof and also adapted to be easily disassembled by a tool extending through an opening (not labeled) which communicates the reception space 10 with an exterior, e.g., the space above the upper face (not labeled) of the first connector 1.

While the present invention has been described with reference to a specific embodiment, the description is illustrative of the invention and is not to be construed as limiting the invention. Therefore, various modifications to the present invention can be made to the preferred embodiment by those skilled in the art without departing from the true spirit and scope of the invention as defined by the appended claims.

What is claimed is:

1. A first connector and second connector clamping a printed circuit board, wherein the first connector comprises a first body portion having a reception space defined from a bottom to a top thereof, the printed circuit board defines a hole registering with the reception space, and the second connector comprises a second body portion defining a recess for receiving a board lock which has a fixed section engaged within the recess and a pair of spring prongs connected to the fixed section and retained in the reception space of the first connector, whereby the first connector and the second connector clamp the printed circuit board therebetween;

wherein the reception space of the first connector converges upwardly first and then diverges upwardly to the top of the second body portion, thereby forming a pair of positioning steps facing each other;

wherein each of the spring prongs of the board lock has a bent head for abutting against the corresponding positioning step of the first connector.

* * * * *